United States Patent [19]

Gamble

[11] 4,368,887

[45] Jan. 18, 1983

[54] RANDOM SELECTOR

[76] Inventor: John Gamble, 440 Rathburn Rd., Etobicoke, Ontario M9C 3S7, Canada

[21] Appl. No.: 244,667

[22] Filed: Mar. 17, 1981

[30] Foreign Application Priority Data

Nov. 7, 1980 [CA] Canada ..... 364306

[51] Int. Cl.[3] ..... A63F 7/04

[52] U.S. Cl. ..... 273/144 B

[58] Field of Search ..... 273/144 R, 144 A, 144 B, 273/145 B, 145 C

[56] References Cited

U.S. PATENT DOCUMENTS

| | | | |
|---|---|---|---|
| 526,946 | 10/1894 | Schleininger | 273/144 B |
| 2,233,589 | 3/1941 | Dean | 273/144 B |
| 2,296,001 | 9/1942 | Slattery | 273/145 C |
| 2,448,151 | 8/1948 | Noel | 273/144 B |
| 3,508,755 | 4/1970 | Johnson | 273/145 C |
| 3,534,964 | 10/1970 | Guill | 273/144 A |

FOREIGN PATENT DOCUMENTS

| | | | |
|---|---|---|---|
| 2400738 | 4/1979 | France | 273/144 B |
| 93673 | 12/1938 | Sweden | 273/144 B |
| 278018 | 1/1952 | Switzerland | 273/144 B |
| 191693 | 5/1923 | United Kingdom | 273/144 B |
| 722014 | 1/1955 | United Kingdom | 273/144 B |

*Primary Examiner*—Richard C. Pinkham
*Assistant Examiner*—Arnold W. Kramer
*Attorney, Agent, or Firm*—Birch, Stewart, Kolasch & Birch

[57] ABSTRACT

A selector device is provided herein for the random selection of a small set of balls from a larger set of balls. It includes a flat box having a transparent cover. The box is divided into an upper chamber and a lower chamber, the upper chamber containing a large set of balls therein, with a small set of the balls having a significantly different appearance from the first set of balls, e.g., by being colored differently. The lower chamber is formed by parallel channels through apertures. The channels are just slightly wider than the diameter of the balls. All connections between the upper chamber and the channels are provided with rounded corners. In this way, each channel has an unimpeded entry mouth from the upper chamber. Finally, spaced-apart, indicia are arranged in longitudinal rows each along a respective channel. In this way, a chance selector device is provided in which the balls have an unhindered access by gravity to the channels, which permits truly random selection.

22 Claims, 18 Drawing Figures

RANDOM SELECTOR

BACKGROUND OF THE INVENTION (i) Field of the Invention

This invention relates to a selector for the random selection of a predetermined number of elements, e.g., a set of numbers from a larger predetermined number of elements, e.g., a set of numbers.

There are many games of chance which require the selection of a small set of elements from a larger set of elements. Among the more popular such games of chance are government-sponsored lotteries. For example, there is a loto game in Ontario which consists of correctly selecting six numbers from thirty-nine numbers to be a winner. In addition, there is a loto game in Quebec which consists of correctly selecting six numbers from thirty-six numbers in order to be a winner.

(ii) Description of the Prior Art

There are many chance selector devices, among them being those shown in Canadian Pat Nos. 74,159; 162,663; 909,285; 945,581; and 1,084,077. Nevertheless, none of these chance selectors will provide for the random selection of a predetermined small set of elements, e.g., numbers, from a larger predetermined set of elements, e.g., numbers.

A random selector of the type with which the present invention is concerned has been proposed which included a plurality of captive balls which would drop by gravity and at random into a pair of chutes. However, this selector suffers the disadvantage that the balls tended to jam at the entrances to the chutes and any attempt to dislodge the jam effectively upset the random selection.

SUMMARY OF THE INVENTION (i) Aims of the Invention

Accordingly, it is an object of this invention to provide an improved chance selector device for randomly selecting a small set of numbers from a larger set of numbers.

Another object of this invention is to provide embodiments of a "three-drop" variant (in which three channels are provided), of a "two-drop" variant (in which two channels are provided), and a further embodiment of a "four-drop" variant (in which four channels are provided), whether the numbered indicia are consecutively or randomly displayed.

(ii) Statement of Invention

By this invention, a selector device is provided for the random selection of a small set of elements from a larger set of elements comprising: (a) a flat, generally rectangular parallelepiped enclosure including a base, two side walls, two end walls, and a transparent cover; (b) a rectangular upper chamber having an upper wall, two parallel side walls and a lower wall provided in the enclosure, situated in the space between the base and the cover, the upper chamber containing a plurality of balls therein, the plurality of balls being equal in number to the larger set of elements, a smaller plurality of such balls, equal in number to the smaller set of elements, having a significantly different appearance from the first plurality of balls; (c) a plurality of discrete longitudinally-extending parallel channels connected to the upper chamber through a like plurality of apertures in the lower wall, the channels being disposed in the lower portion of the enclosure, the channels being slightly wider than the diameter of the balls, the lower edges of the parallel side walls of the upper chamber being connected to the lower wall by means of rounded corners of approximately the same diameter as the balls, the apertures leading to the channels being provided with rounded corners, thereby providing each channel with an unimpeded entry mouth from the upper chamber; and (d) a like plurality of spaced-apart, different indicia arranged in longitudinal rows each along a respective selected one of the channels, such indicia being spaced apart a distance equal to the diameter of the balls.

This invention thus provides such a selector device in which the spaced-apart different indicia are randomly displayed in the longitudinal rows.

This invention also provides such a selector device in which the spaced-apart different indicia are displayed consecutively in the longitudinal rows.

(iii) Other Features of the Invention

By another feature of this invention, the indicia are numbers and the random selection of elements is of a set of six numbers from a set of thirty-nine numbers.

By another feature of this invention, the channels are provided by a plurality of spaced-apart, longitudinally-extending spacers intruding into the lower portion of the enclosure from the base to the transparent cover.

By another feature of this invention, there are two lateral spacers, two intermediate spacers and three channels.

By another feature of this invention, there are two lateral spacers, one intermediate spacer and two channels.

By another feature of this invention, there are two lateral spacers, three intermediate spacers and four such channels.

By another feature of this invention, the balls are ball bearings.

By another feature of this invention, a small set of the ball bearings are black colored, while the remainder of the ball bearings are silver colored.

By another feature of this invention, the base, the end walls and the side walls are injection molded.

By another feature of this invention, the number of balls is 39; there is a random set of 13 numbers selected from 1–39 in a first longitudinal row; a random set of different 13 numbers selected from 1–39 in a second longitudinal row; and a random set of still further different 13 numbers in a third longitudinal row.

By another feature of this invention, the number of balls is 39; there is a random set of 20 numbers selected from 1–39 in a first longitudinal row; and a random set of different 19 numbers selected from 1–39 in a second longitudinal row.

By another feature of this invention, the number of balls is 39; there is a consecutive set of numbers 1–9 in a first longitudinal row; a second consecutive set of numbers 10–19 in a second longitudinal row; a third consecutive set of numbers 20–29 in a third longitudinal row; and a fourth consecutive set of numbers 30–39 in a fourth longitudinal row.

BRIEF DESCRIPTION OF THE DRAWINGS

In the accompanying drawings.

Figure 1:
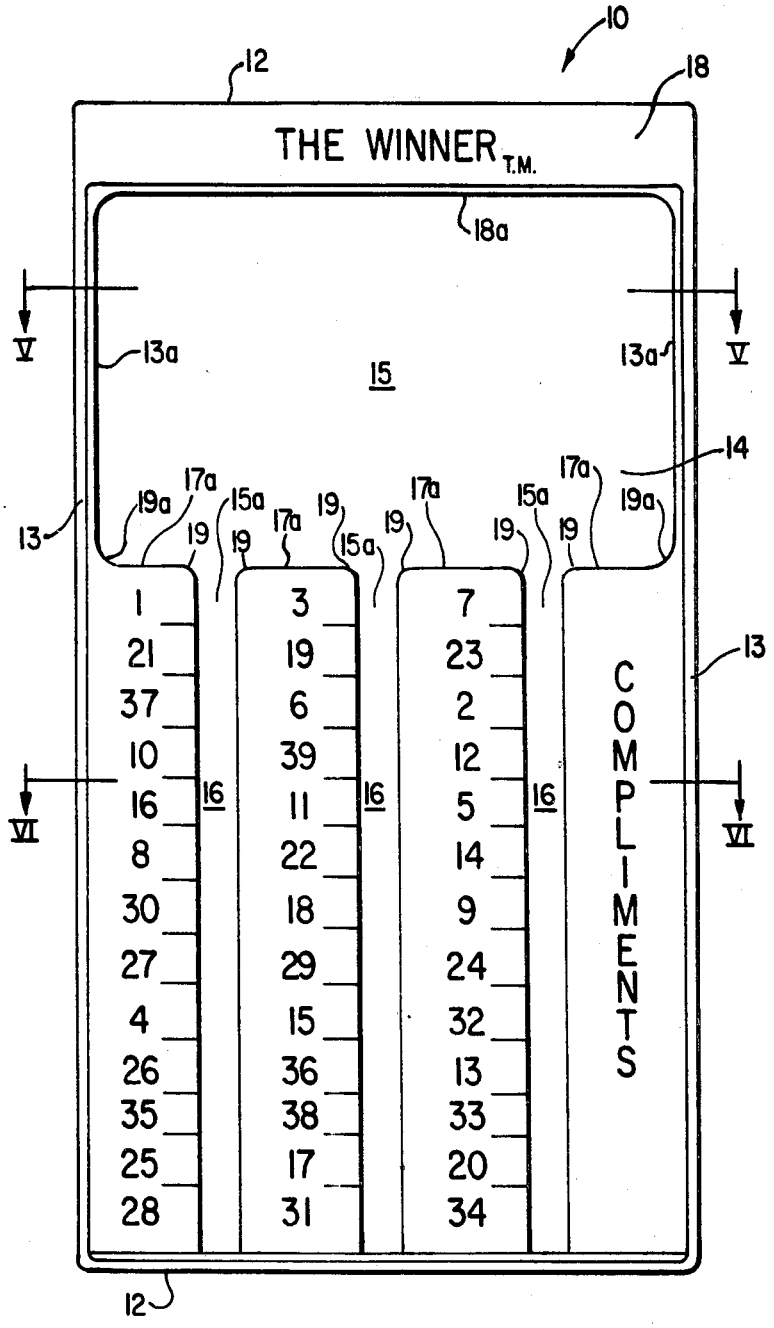
FIG. 1 is a front elevational view of the selector of one embodiment of this invention.
Figure 2:
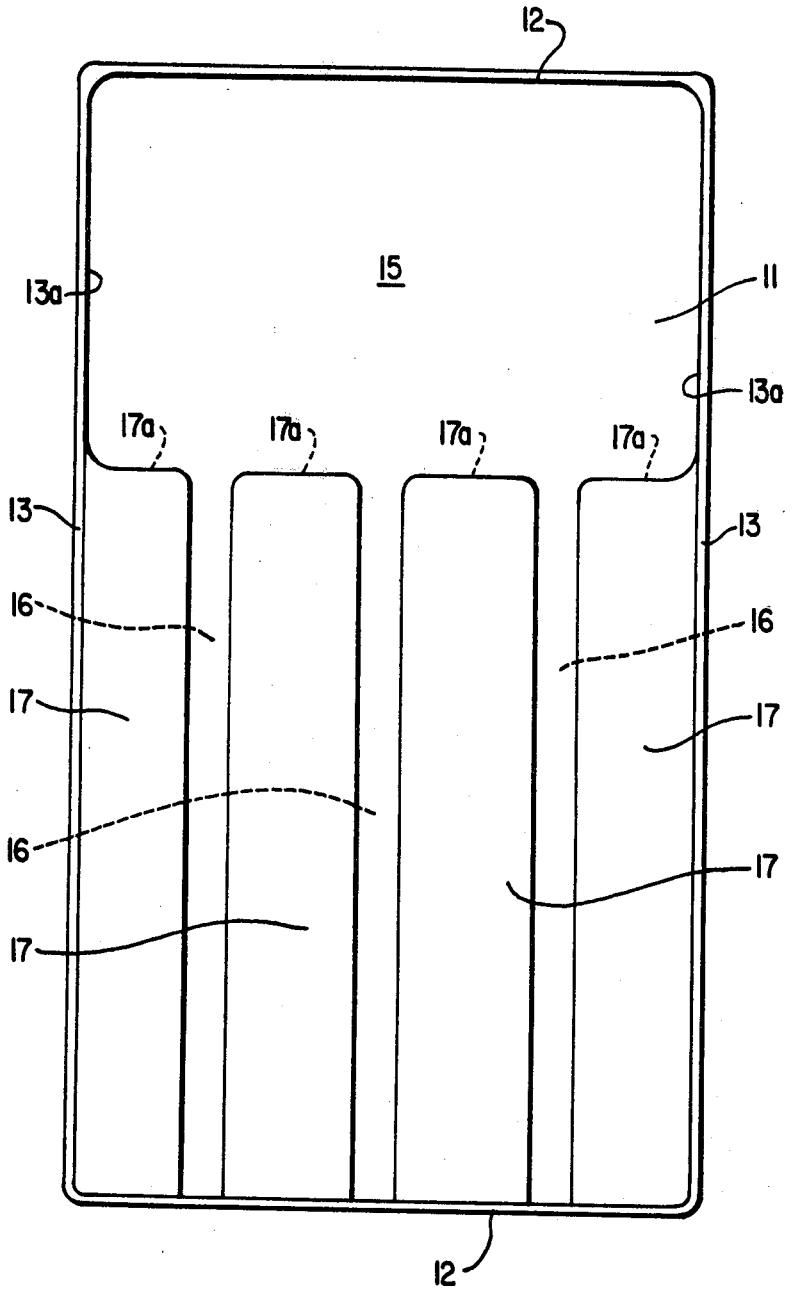
FIG. 2 is a rear elevational view of the selector of FIG. 1.
Figure 4:
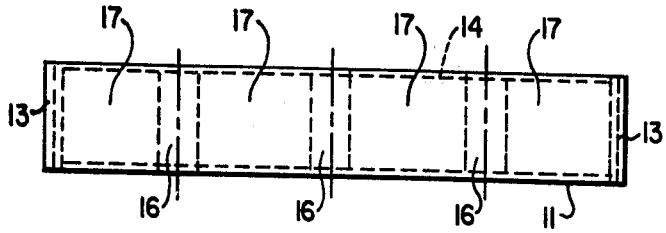
FIG. 4 is a bottom end view of the selector of FIG. 1.
Figure 5:
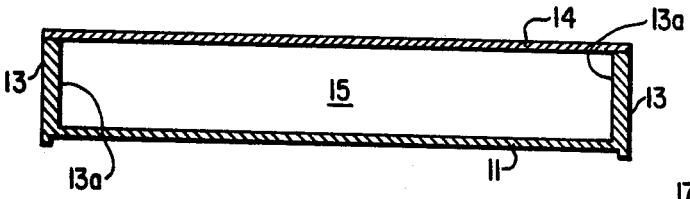
FIG. 5 is a transverse section along the line V—V of FIG. 1.
Figure 6:
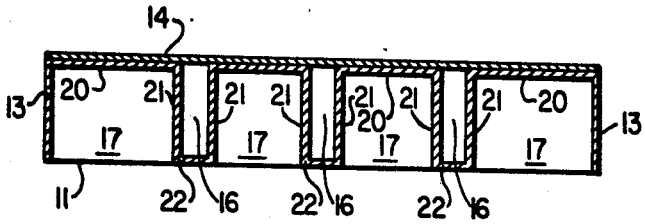
FIG. 6 is a transverse section of the line VI—VI of FIG. 1.
Figure 3:
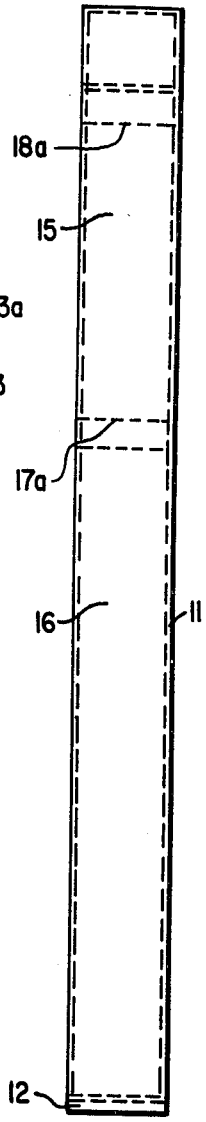
FIG. 3 is a side elevational view of the selector of FIG. 1.

DESCRIPTION OF PREFERRED EMBODIMENTS (i) Description of FIGS. 1–6

As seen in FIGS. 1–6, the random selector 10 of one embodiment of the invention comprises a box-like structure including a base 11, a pair of end walls 12, a pair of side walls 13, and a transparent front cover 14. The base, end walls and side walls are preferably made of a synthetic plastic material, e.g., polyethylene, glass-fiber reinforced resin, polypropylene, polyvinylchloride, ABS plastic, etc. Most preferably, the entire base, end walls and side walls are injection molded from a suitable injection-moldable plastic material. The transparent front cover is preferably made of a transparent acrylic plastic, e.g., polymethylmethacrylate, or of the materials known by the Trade Marks of MYLAR or SARAN.

The selector 10 is divided into a rectangular upper chamber 15 having an upper facia 18, a pair of parallel side walls 13*a*, a transverse upper member or spacer 19, and a transverse lower member or spacer 17*a*, and into a plurality of longitudinally-extending, parallel lower channels 16 connected to the lower wall 17*a* of the upper chamber 15 through apertures 15*a*. The lower channels 16 may be provided, as shown on the drawings, by a series of spaced-apart, longitudinally-extending channels 17 projecting upwardly from the base 11 to the cover 14 and preferably formed by injection molding of the base, end walls, and side walls. The channels 17 are defined by upper wall 20, and enclose channels 16 by means of spaced-apart side walls 21 and bottom wall 22. On the other hand, while not shown, the channels 16 may be formed by spaced-apart, inner, shaped blocks, similar in shape to channels 17, to define channels 16. In any event, the upper portions of channels 17 (or their equivalents blocks) are formed with rounded-off corners 19 at apertures 15*a* to permit unhindered access to the channels 16. In addition, unhindered access is provided by rounded-off corners 19*a* at the intersection of side walls 13*a* and floor 17*a*, the rounded-off corners 19*a* being of approximately the same diameter as that of the balls.

Within upper chamber 15 is a plurality of balls (not shown) which are equal in number to the larger set of elements, e.g., numbers. For example, if the selection is to be from thirty-nine (39) numbers, three will be a total of 39 balls. A small discrete number of balls, equal to the smaller set of elements, e.g., numbers, have a significantly different appearance from the rest of the balls. For example, if the selection is to be of six (6) from thirty-nine (39), six balls will be colored black, while the remainder of the balls will be colored silver. It is preferred that the balls be ball bearing balls, since they are durable, inexpensive, and readily available.

The channels 16 are marked with randomly selected, spaced-apart different indicia, e.g., numbers, from 1–39. The number of channels 16 is two if there is an even number of balls, and is three if (as in this embodiment) there is an odd number of balls.

Figure 7:
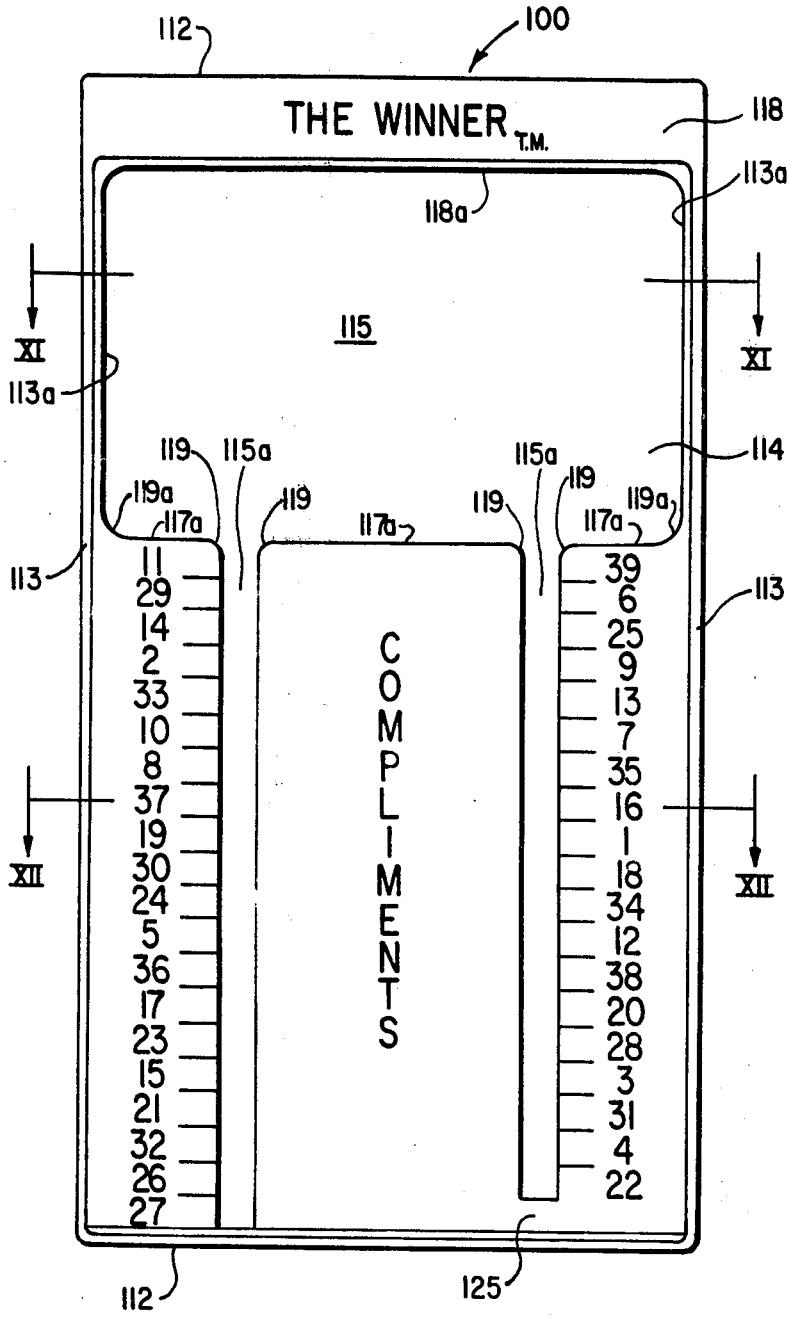
FIG. 7 is a front elevational view of the selector of another embodiment of this invention.
Figure 8:
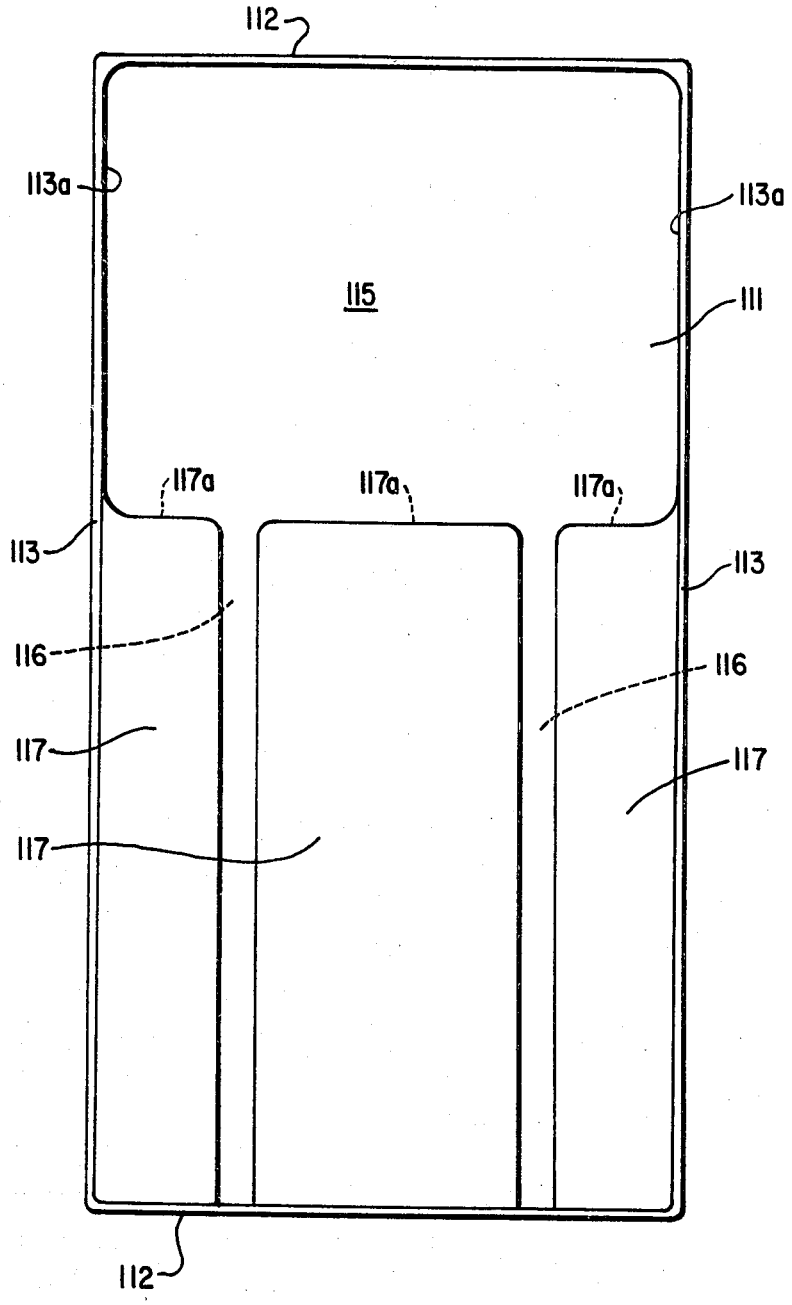
FIG. 8 is a rear elevational view of the selector of FIG. 7.
Figure 10:
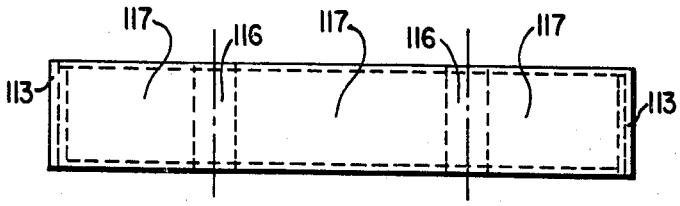
FIG. 10 is a bottom end view of the selector of FIG. 7.
Figure 11:
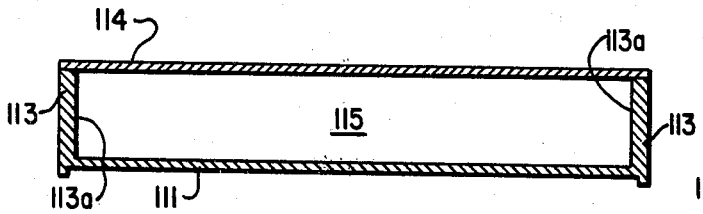
FIG. 11 is a transverse section along the line XI—XI of FIG. 7.
Figure 12:
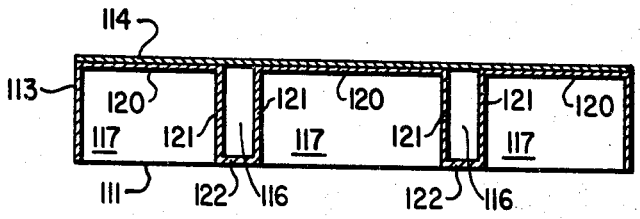
FIG. 12 is a transverse section along the line XII—XII of FIG. 7.
Figure 9:
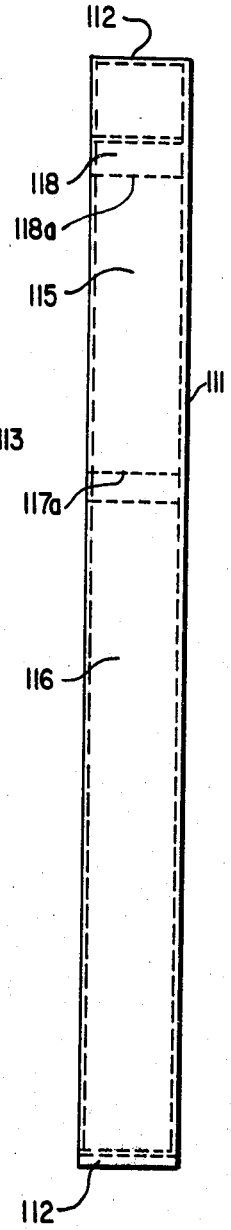
FIG. 9 is a side elevational view of the selector of FIG. 7.

(ii) Description of FIGS. 7–12

As seen in FIGS. 7–12, the random selector 100 of another embodiment of the invention comprises a box-like structure including a base 111, a pair of end walls 112, a pair of side walls 113, and a transparent front cover 114. The base, end walls and side walls are, as described with reference to the first embodiment, preferably made of a synthetic plastic material, e.g., polyethylene, glass-fiber reinforced resin, polypropylene, polyvinylchloride, ABS plastic, etc. The transparent front cover is, as also described with reference to the first embodiment, preferably made of a transparent acrylic plastic, e.g., polymethylmethacrylate, or of the materials known by the Trade Marks of MYLAR or SARAN.

The selector 100 is divided into a rectangular upper chamber 115 having an upper facia 118, a pair of parallel side walls 113*a*, a transverse upper member or spacer 118*a*, and a transverse lower member or spacer 117*a*, and into a plurality of longitudinally-extending, parallel lower channels 116 connected to the lower wall 117*a* of the upper chamber 115 through apertures 115*a*. The lower channels 116 may be provided, as shown in the drawings, by a series of spaced-apart, longitudinally-extending channels 117 projecting upwardly from the base 111 to the cover 114 and preferably formed by injection molding of the base, end walls and side walls. The channels 117 are defined by upper wall 120, and enclose channels 116 by means of spaced-apart side walls 121 and bottom wall 122. On the other hand, while not shown, the channels 116 may be formed by spaced-apart, inner, shaped blocks, similar in shape to channels 117 to define channels 116. In any event, the upper portions of channel 117 (in their equivalent blocks) are formed with rounded-off corners 119 at apertures 115*a* to permit unhindered access to the channels 116. In addition, unhindered access is provided by rounded-off corners 119*a* at the intersections of side walls 113*a* and floor 117*a*, the rounded-off corners 119*a* being of approximately the same diameter as that of the balls.

Within upper chamber 115 is a plurality of balls (not shown) which are equal in number to the larger set of elements, e.g., numbers. For example, if the selection is to be from thirty-six (36) numbers, there will be a total of 36 balls. A smaller discrete number of balls equal to the smaller set of elements, e.g., numbers, have a significantly different appearance from the rest of the balls.

For example, if the selection is to be of six (6) from thirty-six (36), six balls will be black colored, while the remainder of the balls will be silver colored. It is preferred that the balls be ball bearing balls, since they are durable, inexpensive, and readily available.

The channels 116 are marked with randomly selected, spaced-apart different indicia, e.g., numbers, from 1–36. The number of channels 116 is two if (as in this embodiment) there is an even number of balls, and is three if there is an odd number of balls. As shown, the second (or right hand) column is one ball shorter provided by lower block 125.

Figure 13:
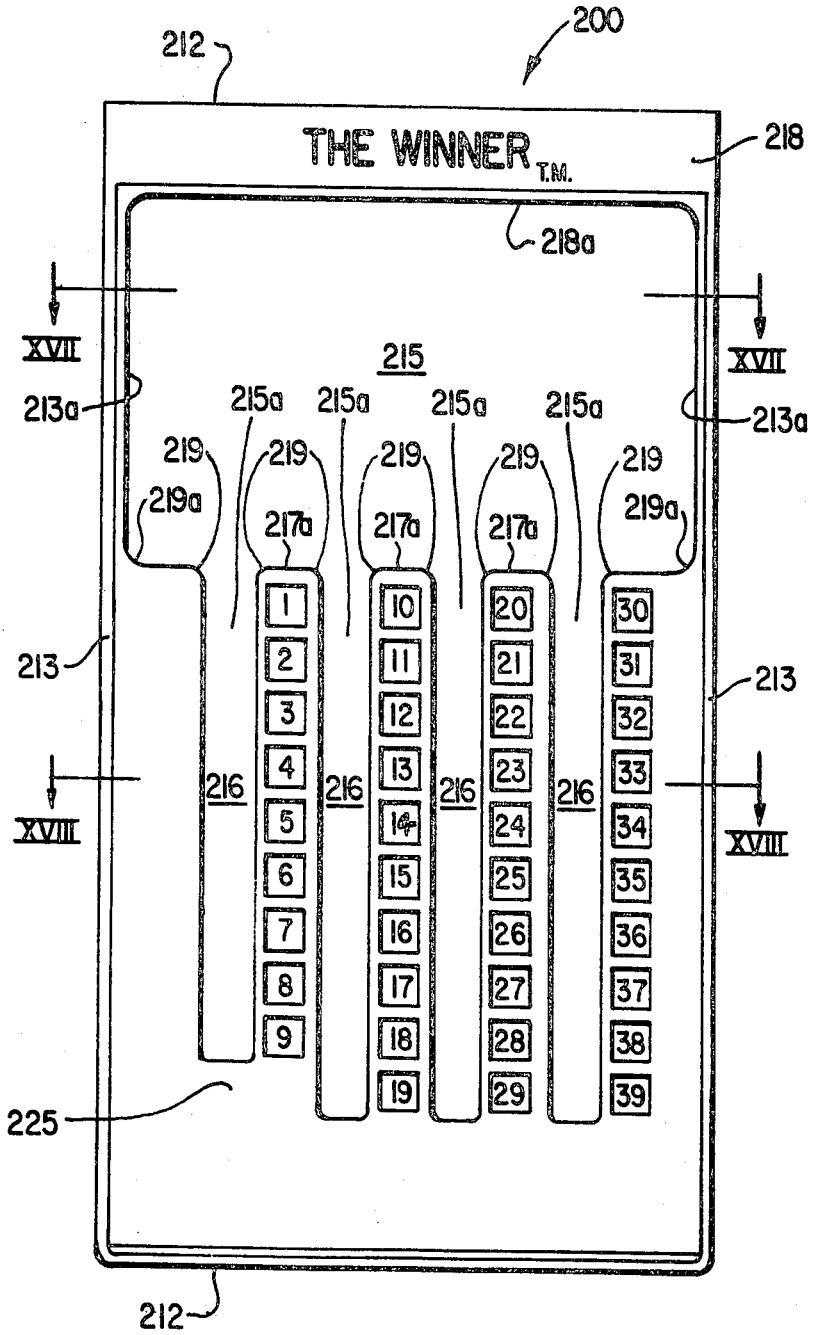
FIG. 13 is a front elevational view of the selector of yet another embodiment of this invention.
Figure 14:
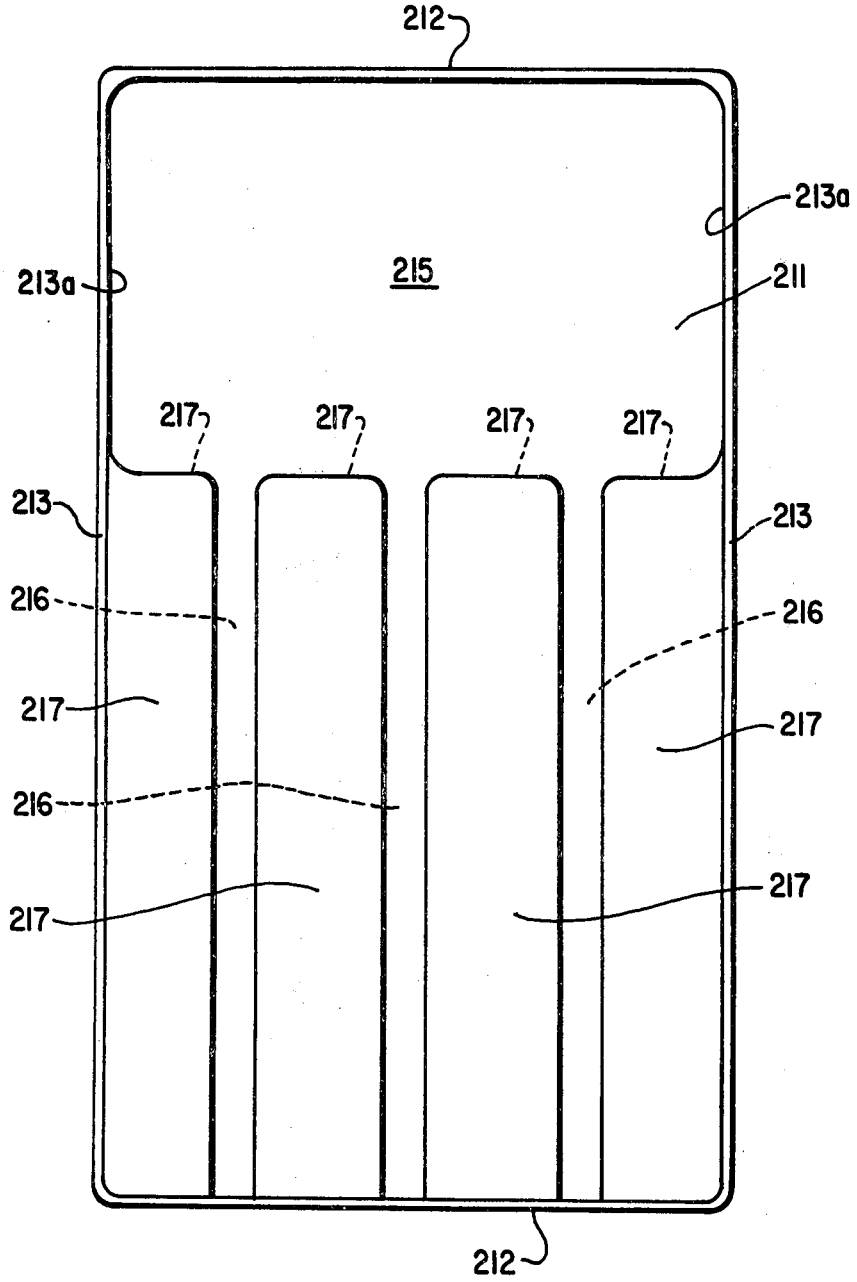
FIG. 14 is a rear elevational view of the selector of FIG. 13.
Figure 16:
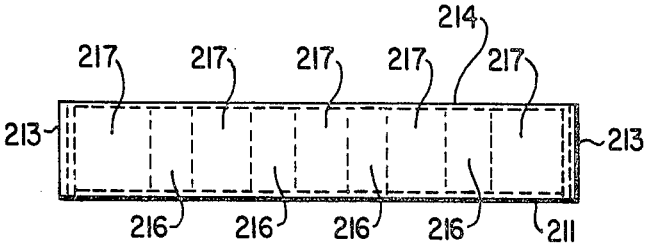
FIG. 16 is a bottom end view of the selector of FIG. 13.
Figure 17:
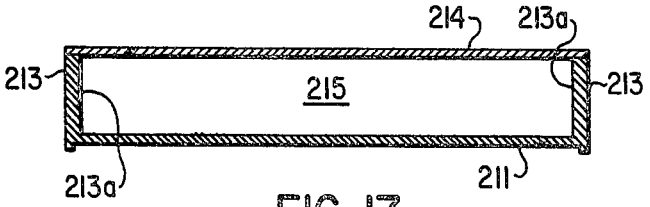
FIG. 17 is a transverse section along the line XVII—XVII of FIG. 13.
Figure 18:
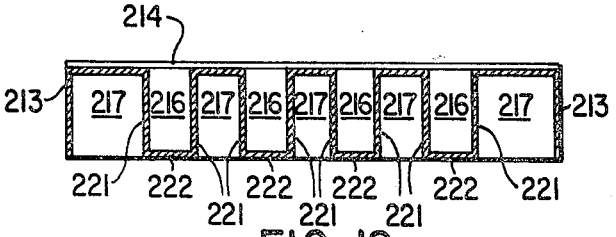
FIG. 18 is a transverse section along the line XVIII—XVIII of FIG. 13.
Figure 15:
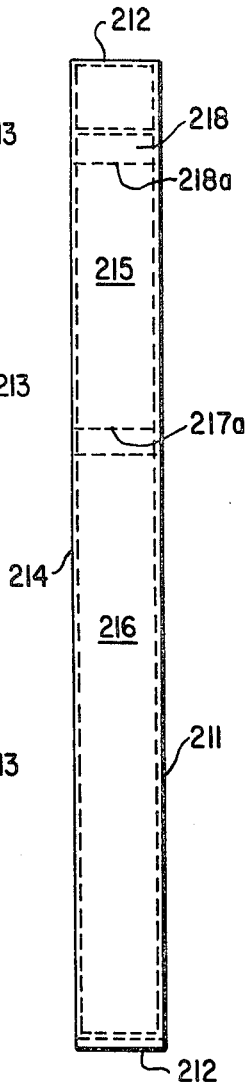
FIG. 15 is a side elevational view of the selector of FIG. 13.

(iii) Description of FIGS. 13–18

As seen in FIGS. 13–18, the random selector 200 of yet another embodiment of the invention comprises a box-like structure including a base 211, a pair of end walls 212, a pair of side walls 213, and a transparent front cover 214. The base, end walls and side walls are, as described with reference to the first embodiment, preferably made of a synthetic plastic material, e.g., polyethylene, glass-fiber reinforced resin, polypropylene, polyvinylchloride, ABS plastic, etc. The transparent front cover is, as also described with reference to the first embodiment, preferably made of a transparent acrylic plastic, e.g., polymethylmethacrylate, or of the materials known by the Trade Marks of MYLAR or SARAN.

The selector 200 is divided into a rectangular upper chamber 215 having an upper facia 218, a pair of parallel side walls 213*a*, a transverse upper member or spacer 218, and a transverse lower member or spacer 217*a*, and into a plurality of longitudinally-extending, parallel lower channels 216 connected to the lower wall 217*a* of the upper chamber 215 through apertures 215*a*. The lower channels 216 may be provided, as shown in the drawings, by a series of spaced-apart, longitudinally-extending channels 217 projecting upwardly from the base 211 to the cover 214 and preferably formed by injection molding of the base, end walls and side walls. The channels 217 are defined by upper wall 220, and enclose channels 216 by means of spaced-apart side walls 221 and bottom wall 222. On the other hand, while not shown, the channels 216 may be formed by spaced-apart, inner, shaped blocks, similar in shape to channels 217 to define channels 216. In any event, the upper portions of channel 217 (in their equivalent blocks) are formed with rounded-off corners 219 at apertures 215*a* to permit unhindered access to the channels 216. In addition, unhindered access is provided by rounded-off corners 219*a* at the intersections of side walls 213*a* and floor 217*a*, the rounded-off corners 219*a* being of approximately the same diameter as that of the balls.

Within upper chamber 215 is a plurality of balls (not shown) which are equal in number to the larger set of elements, e.g., numbers. For example, if the selection is to be made from thirty-six (36) numbers, there will be a total of 36 balls. A smaller discrete number of balls equal to the smaller set of elements, e.g., numbers, have a significantly different appearance from the rest of the balls. For example, if the selection is to be of six (6) from thirty-six (36), six balls will be black colored, while the remainder of the balls will be silver colored. It is preferred that the balls be ball bearing balls, since they are durable, inexpensive, and readily available.

The channels 216 are numbered with consecutive spaced-apart different indicia, namely, 1–9 in the first row, 10–19 in the second row, 20–29 in the third row, and 30–39 in the fourth row. There are no indicia on the fifth spacer. As shown, and to balance the rows, the first (or left hand) channel is provided with a lower block 225 to allow only nine balls into that first channel.

OPERATION OF PREFERRED EMBODIMENTS (i) Operation of Embodiment of FIGS. 1–6

In use, the chance selector 10 is shaken and the balls allowed to fall at random by gravity into the channels 16. The six numbers to be selected are those occupying the indicia areas in the channels opposite to the block balls.

While dimensions are a matter of wide variance, in the embodiment shown in FIGS. 1–6, the overall dimensions are $4\frac{1}{4}'' \times 2\frac{1}{4}''$. The lower transverse spacer is $\frac{1}{4}''$ wide, the lateral longitudinal spacers are each 7/16" wide and the intermediate longitudinal spacers are each 15/32" wide, providing three channels 3/16" wide. The upper chamber is $1\frac{1}{2}''$ high.

(ii) Operation of Embodiment of FIGS. 7–12

In use, the chance selector 100 is shaken and the balls allowed to fall at random by gravity into the channels 116. The six numbers to be selected are those occupying the indicia areas in the channels opposite to the black balls. Twenty balls are permitted into the left hand channel, while only nineteen balls are permitted into the right hand channel.

The overall dimensions of the embodiment of FIGS. 7–12 are the same as those of the embodiment of FIGS. 1–6, and, in fact, the only difference is in the width of the longitudinal spacers. The two lateral such spacers are each $\frac{1}{2}''$ wide, while the mid-spacer is $\frac{7}{8}''$ wide, leaving two channels 5/16" wide.

(iii) Operation of Embodiment of FIGS. 13–18

In use, the chance selector 200 is shaken and the balls allowed to fall at random by gravity into the channels 216. The six numbers to be selected are those occupying the indicia areas in the channels opposite to the black balls. Nine balls are permitted into the left hand channel, while ten balls are each permitted into the three other channels.

The overall dimensions of the embodiment of FIGS. 13–18 are the same as those of the embodiment of FIGS. 1–6, and, in fact, the only difference is in the width of the longitudinal spacers. The lateral such spacers are each $\frac{1}{2}''$ wide, while the three intermediate spacers are each 21/32" wide, thereby leaving four channels 5/15" wide each.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A selector device for the random selection of a small set of elements from a larger set of elements comprising:

(a) a flat, generally rectangular parallelepiped enclosure including a base, two side walls, two end walls, and a transparent cover;

(b) a rectangular upper chamber having an upper wall, two parallel side walls and a lower wall provided in said enclosure situated in the space between said base and said cover, said upper chamber containing a plurality of balls therein, said plurality of balls being equal in number to said larger set of elements, a smaller plurality of said balls, equal in number to said smaller set of elements, having a significantly different appearance from the first plurality of balls;

(c) a plurality of discrete longitudinally-extending parallel channels connected to said upper chamber through a like plurality of apertures in the lower wall, the channels being disposed in the lower portion of said enclosure, said channels being slightly wider than the diameter of said balls, the lower edges of said parallel side walls of said upper chamber being connected to said lower wall by means of rounded-off corners of approximately the same diameter as the balls, the apertures leading to said channels being provided with rounded corners, thereby providing each channel with an unimpeded entry mouth from said upper chamber; and (d) a like plurality of spaced-apart different indicia arranged in longitudinal rows each along a respective selected one of said channels, such indicia being spaced apart a distance equal to the diameter of said balls, the number of said indicia being equal to the number of said balls.

2. The selector device of claim 1 wherein said spaced-apart different indicia are randomly displayed in said longitudinal rows.

3. The selector device of claim 2 wherein said indicia are numbers, and wherein said random selection of elements is of a set of six numbers from a set of thirty-nine numbers.

4. The selector device of claim 2 wherein said balls are ball bearings.

5. The selector device of claim 4 wherein a small set of said ball bearings are black colored, while the remainder of the ball bearings are silver colored.

6. The selector device of claim 2 wherein said base, said end walls and said side walls are injection molded.

7. The selector device of claim 2 wherein said channels are provided by a plurality of spaced-apart, longitudinally-extending spacers intruding into the lower portion of said enclosure from said base to said transparent cover.

8. The selector device of claim 7 wherein there are two lateral spacers, two intermediate spacers and three channels.

9. The selector device of claim 8 wherein the number of balls is 39; wherein said indicia is a random set of 13 numbers selected from 1–39 in a first longitudinal row; a random set of different 13 numbers selected from 1–39 in a second longitudinal row; and a random set of still further different 13 numbers in a third longitudinal row.

10. The selector device of claim 7 wherein there are two lateral spacers, one intermediate spacer and two channels.

11. The selector device of claim 10 wherein the number of balls is 39; wherein said indicia is a random set of 20 numbers selected from 1–39 in a first longitudinal row; and a random set of different 19 numbers selected from 1–39 in a second longitudinal row.

12. The selector device of claim 7 wherein there are two lateral spacers, three intermediate spacers and four such channels.

13. A selector device for the random selection of a small set of elements from a larger set of elements comprising:

(a) a flat, generally rectangular parallelepiped enclosure including a base, two side walls, two end walls, and a transparent cover;

(b) a rectangular upper chamber having an upper wall, two parallel side walls and a lower wall provided in said enclosure situated in the space between said base and said cover, said upper chamber containing a plurality of balls therein, said plurality of balls being equal in number to said larger set of elements, a smaller plurality of said balls, equal in number to said smaller set of elements, having a significantly different appearance from the first plurality of balls;

(c) a plurality of discrete longitudinally-extending parallel channels connected to said upper chamber through a like plurality of apertures in the lower wall, the channels being disposed in the lower portion of said enclosure, said channels being slightly wider than the diameter of said balls, the lower edges of said parallel side walls of said upper chamber being connected to said lower wall by means of rounded-off corners of approximately the same diameter as the balls, the apertures leading to said channels being provided with rounded corners, thereby providing each channel with an unimpeded entry mouth from said upper chamber; and (d) a like plurality of spaced-apart, different indicia arranged in longitudinal rows each along a respective selected one of said channels, such indicia being equal in number to the number of balls, and being consecutively displayed in said longitudinal rows.

14. The selector device of claim 13 wherein said indicia are numbers, and wherein said random selection of elements is of a set of six numbers from a set of thirty-nine numbers.

15. The selector device of claim 13 wherein said channels are provided by a plurality of spaced-apart, longitudinally-extending spacers intruding into the lower portion of said enclosure from said base to said transparent cover.

16. The selector device of claim 15 wherein there are two lateral spacers, two intermediate spacers and three channels.

17. The selector device of claim 15 wherein there are two lateral spacers, one intermediate spacer and two channels.

18. The selector device of claim 15 wherein there are two lateral spacers, three intermediate spacers and four such channels.

19. The selector device of claim 18 wherein the number of balls is 39; wherein said indicia is a consecutive set of numbers 1–9 in a first longitudinal row; a second consecutive set of numbers 10–19 in a second longitudinal row; a third consecutive set of numbers 20–29 in a third longitudinal row; and a fourth consecutive set of numbers 30–39 in a fourth longitudinal row.

20. The selector device of claim 13 wherein said balls are ball bearings.

21. The selector device of claim 20 wherein a small set of said ball bearings are black colored, while the remainder of the ball bearings are silver colored.

22. The selector device of claim 13 wherein said base, said end walls and said side walls are injection molded.

* * * * *